US005894683A

United States Patent [19]

Lin

[11] Patent Number: 5,894,683

[45] Date of Patent: Apr. 20, 1999

[54] SHOCK ABSORBING HEEL BLOCK FOR SHOES

[75] Inventor: Chin Yi Lin, Taichung Hsien, Taiwan

[73] Assignee: Gnan-Jang Plastics Co., Ltd., Taichung Hsien, Taiwan

[21] Appl. No.: 09/012,565

[22] Filed: Jan. 23, 1998

[51] Int. Cl.[6] ..... A43B 21/26; A43B 13/20

[52] U.S. Cl. ..... 36/35 B; 36/29

[58] Field of Search ..... 36/35 R, 35 B, 36/3 B, 71, 28, 29

[56] References Cited

U.S. PATENT DOCUMENTS

Re. 17,890 12/1930 Norwood ..... 36/35 B 3,154,867 11/1964 Strope ..... 36/35 R 4,635,384 1/1987 Huh et al. ..... 36/29

5,224,278 7/1993 Jeon ..... 36/29

*Primary Examiner*—B. Dayoan

*Attorney, Agent, or Firm*—Bacon & Thomas, PLLC

[57] ABSTRACT

A shock absorbing heel block which includes a heel block shell adhered to an outsole and arranged in flush with an insole on the outsole, the heel block shell having a bottom open chamber, and a hollow top wall formed of a convex upper layer curved outwards and a concave bottom layer curved inwards, the convex upper layer and the concave bottom layer defining an air chamber filled with air; and an elastomer fit into the bottom open chamber inside the heel block shell and adhered to the outsole, the elastomer having an oval recess at the top which receives the concave bottom layer of the top wall of the heel block shell.

1 Claim, 5 Drawing Sheets

SHOCK ABSORBING HEEL BLOCK FOR SHOES

BACKGROUND OF THE INVENTION

The present invention relates to a shock absorbing heel structure, and more specifically to a shock absorbing heel block for mounting on an outsole in flush with an insole to absorb shocks.

In order to comfort the foot, several flexible materials have been developed for making soles for shoes. However, these flexible materials cannot effectively absorb shocks when the user walks, runs or jumps. There are known cushion blocks designed for use in shoes to absorb shocks. These cushion blocks are filled with air or a hydraulic fluid. However, these cushion blocks are designed to be installed inside the insole of a shoe, therefore they are not visible from outside when installed. Further, these cushion blocks are commonly expensive.

SUMMARY OF THE INVENTION

It is one object of the present invention to provide a shock absorbing heel block for shoes which effectively absorbs shocks when the user walks, runs or jumps. It is another object of the present invention to provide a shock absorbing heel block for shoes which is effective to bear high pressure from the user's sole. It is still another object of the present invention to provide a shock absorbing heel block for shoes which is comfortable in use. It is still another object of the present invention to provide a shock absorbing heel block for shoes which is easy and inexpensive to manufacture.

To achieve the aforesaid objects, there is provided a shock absorbing heel block comprised of a heel block shell adhered to an outsole and arranged in flush with an insole on the outsole, and an elastomer mounted in a bottom open chamber inside the heel block shell and adhered to the outsole. The heel block shell has a hollow top wall filled with air. The elastomer has an oval top recess which receives the convex bottom layer of the hollow top wall of the heel block shell.

DETAILED DESCRIPTION OF THE PREFERRED EMBODIMENTS

Figure 1:
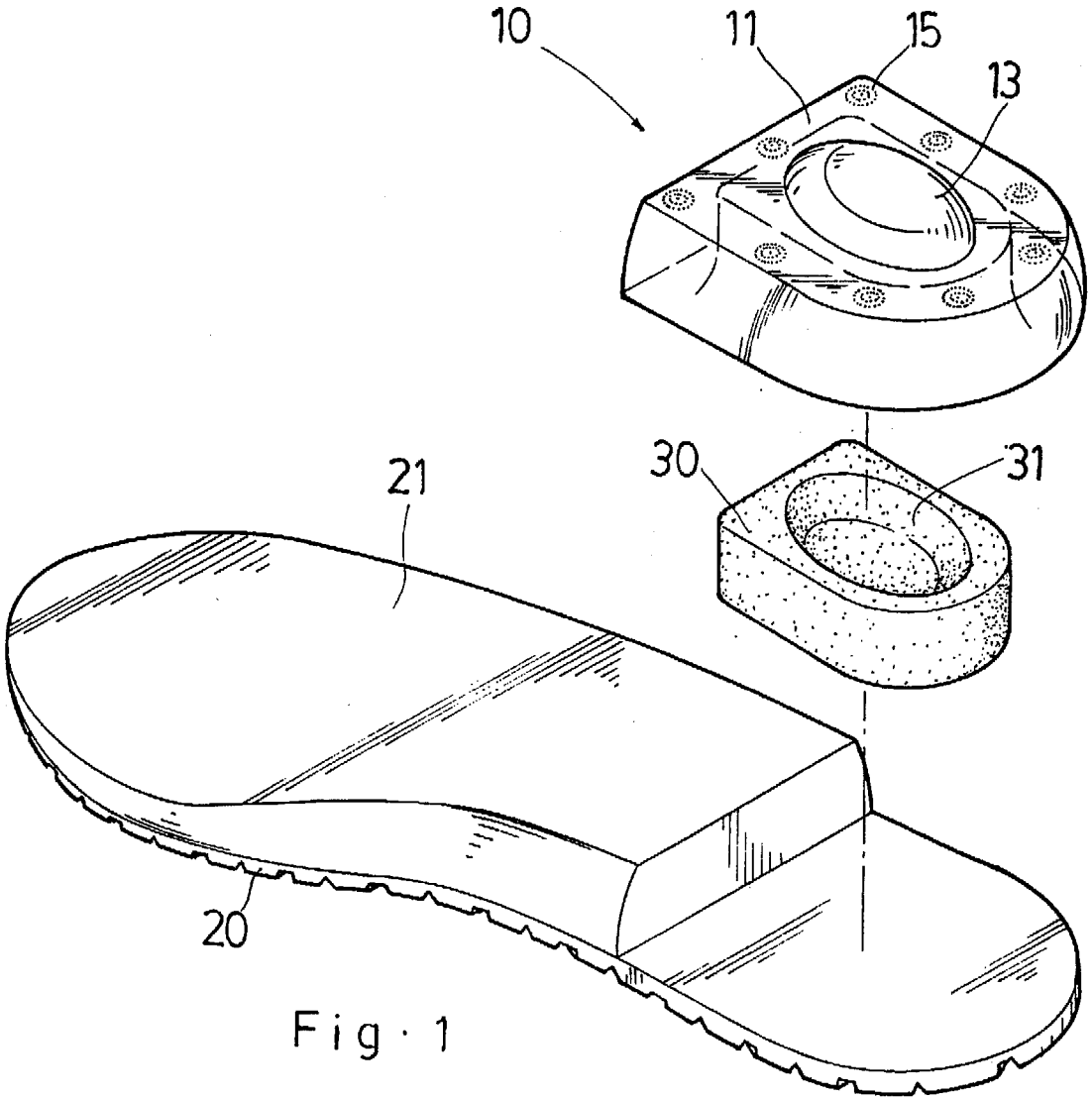
FIG. 1 is an exploded view of the present invention.
Figure 2:
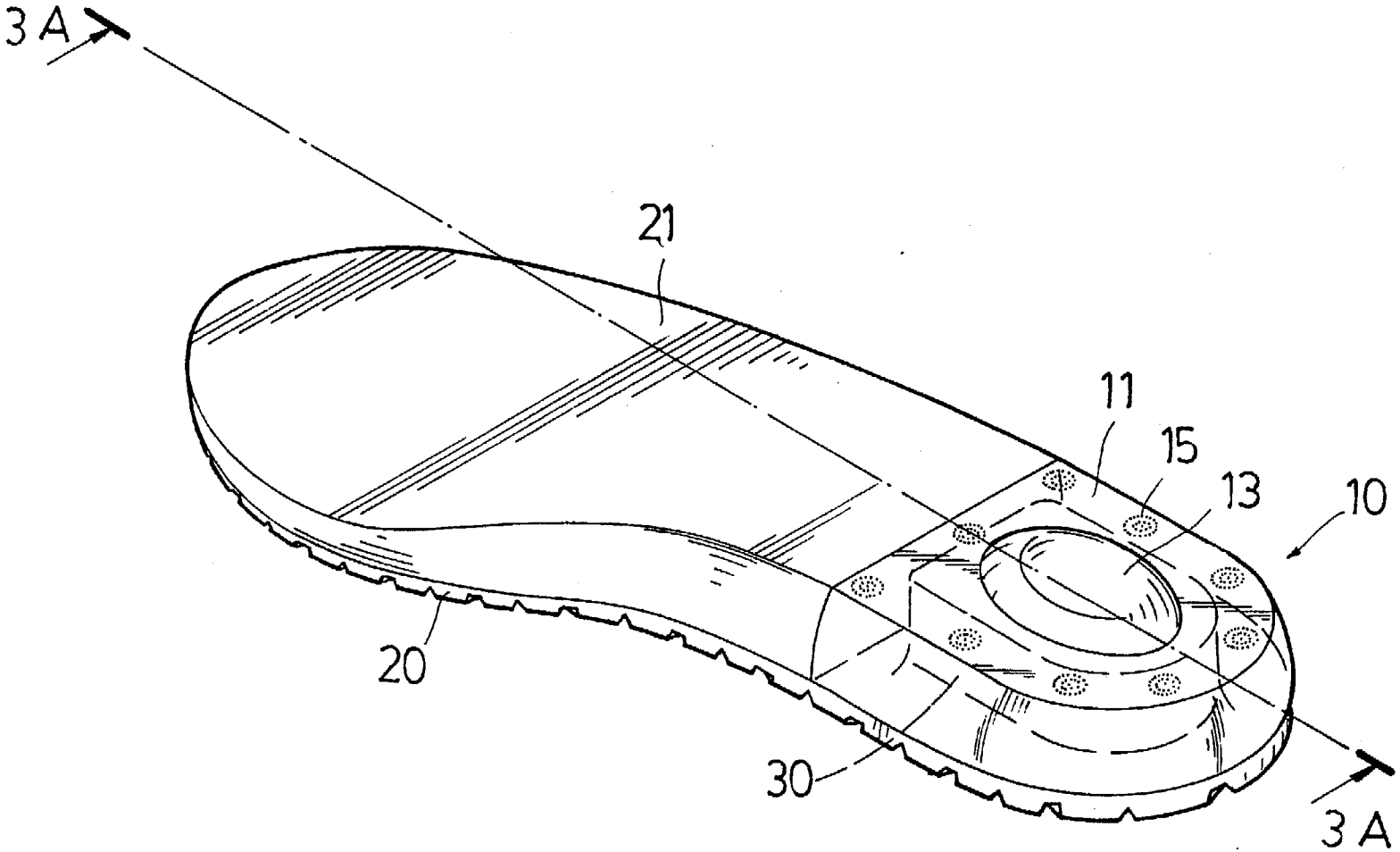
FIG. 2 is a perspective assembly view of FIG. 1.
Figure 3A:
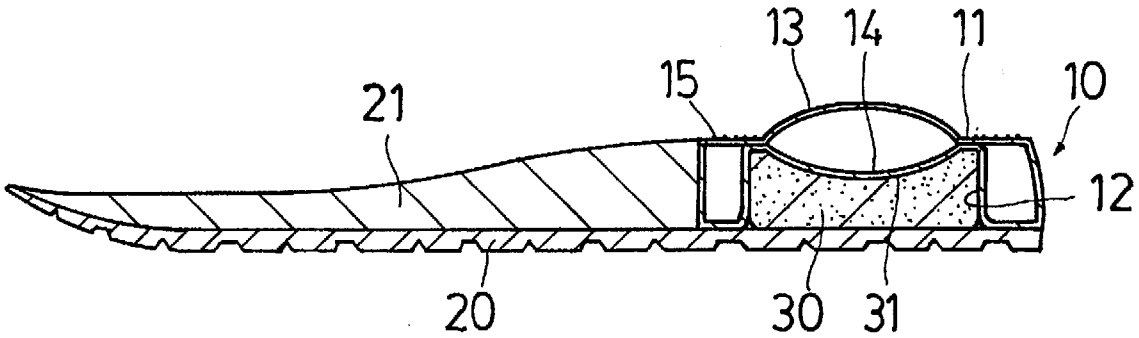
FIG. 3A is a sectional view taken along line 3A—3A of FIG. 2.

Referring to FIGS. 1, 2 and 3A, an insole 21 is mounted on an outsole 20 and covered over the middle and front part of the top wall of the outsole 20. A shock absorbing heel block 10 is mounted on the outsole 20 and covered over the rear part of top wall of outsole 20, and disposed in flush with the insole 21.

The shock absorbing heel block 10 is comprised of a hollow heel block shell 11, and an elastomeric material 30. The heel block shell 11 is made from transparent, flexible material, and defines a bottom open chamber 12, which receives the elastomer 30. The bottom side of the heel block shell 11 is adhered to the top wall of the outsole 20. The middle part of the top wall of the heel block shell 11 has a convex upper layer 13 curved outwards at the top, and a concave bottom layer 14 curved inwards at the bottom. The convex upper layer 13 and the concave bottom layer 14 define an air chamber filled with air. Further, grip portions 15 are provided at the top wall of the heel block shell 11 around the convex upper layer 13. The grip portions 15 impart a friction force to the sole of the user's foot.

The elastomer 30 fits into the bottom open chamber 12 in the heel block shell 11. The bottom side of the elastomer 30 is adhered to the outsole 20. The top side of the elastomer 30 has an oval recess 31, which receives the concave bottom layer 14 of the top wall of the heel block shell 11. After installation, the bottom surface of the concave bottom layer 14 is forced into close contact with the periphery of the oval recess 31 by air pressure.

Figure 4:
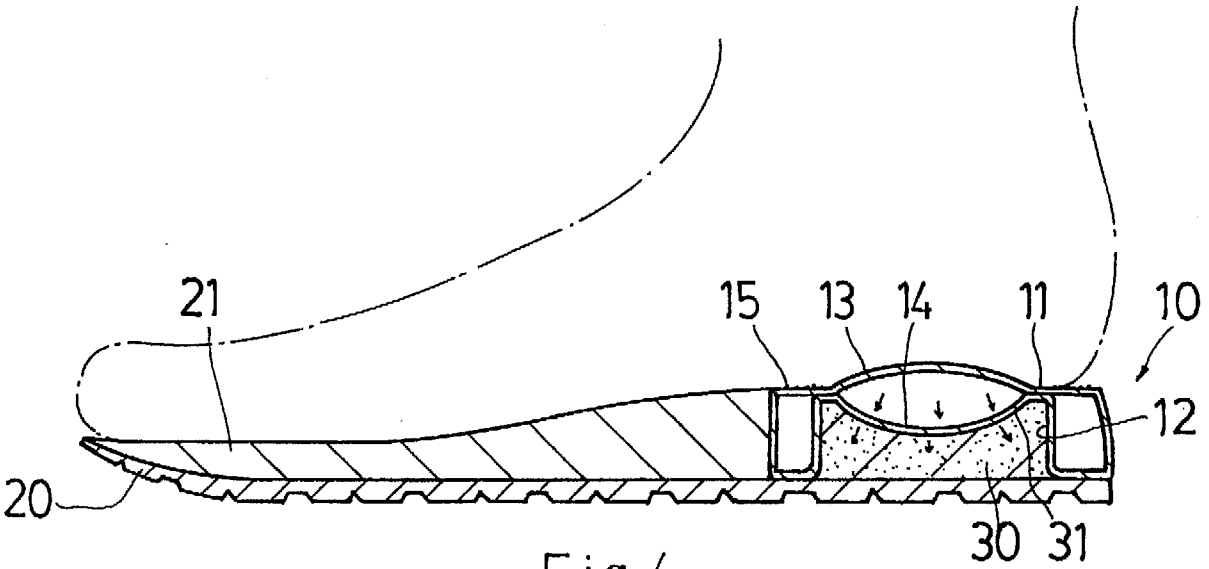
FIG. 4 shows the shock absorbing heel block compressed according to the present invention.

Referring to FIG. 4, when the heel of the foot gives a downward pressure to the shock absorbing heel block 10 during walking, running or jumping, air in the air chamber between the convex upper layer 13 and the concave bottom layer 14 is forced to flow in different directions so as to evenly distribute downward pressure in different directions, at the same time the elastomer 30 is compressed to absorb shocks. Therefore, little reactive force is transmitted from the ground to the heel of the user's foot through the shock absorbing heel block 10. When the shock absorbing heel block 10 receives a downward pressure from the heel of the user's foot and compressed, the convex upper layer 13 of the top wall of the heel block shell 11 is forced to rub the muscles of the heel of the user's foot, and therefore the user's heel is massaged when walking, running or jumping.

The material for the heel block shell 11 is more flexible than the elastomer 30. The user's foot does not feel uncomfortable when touching the heel block shell 11. Because the heel block shell 11 is supported on the elastomer 30, the heel block shell 11 does not collapse, and will be forced to return to its former shape by the elastomer 30 after being pressed.

Figure 5:
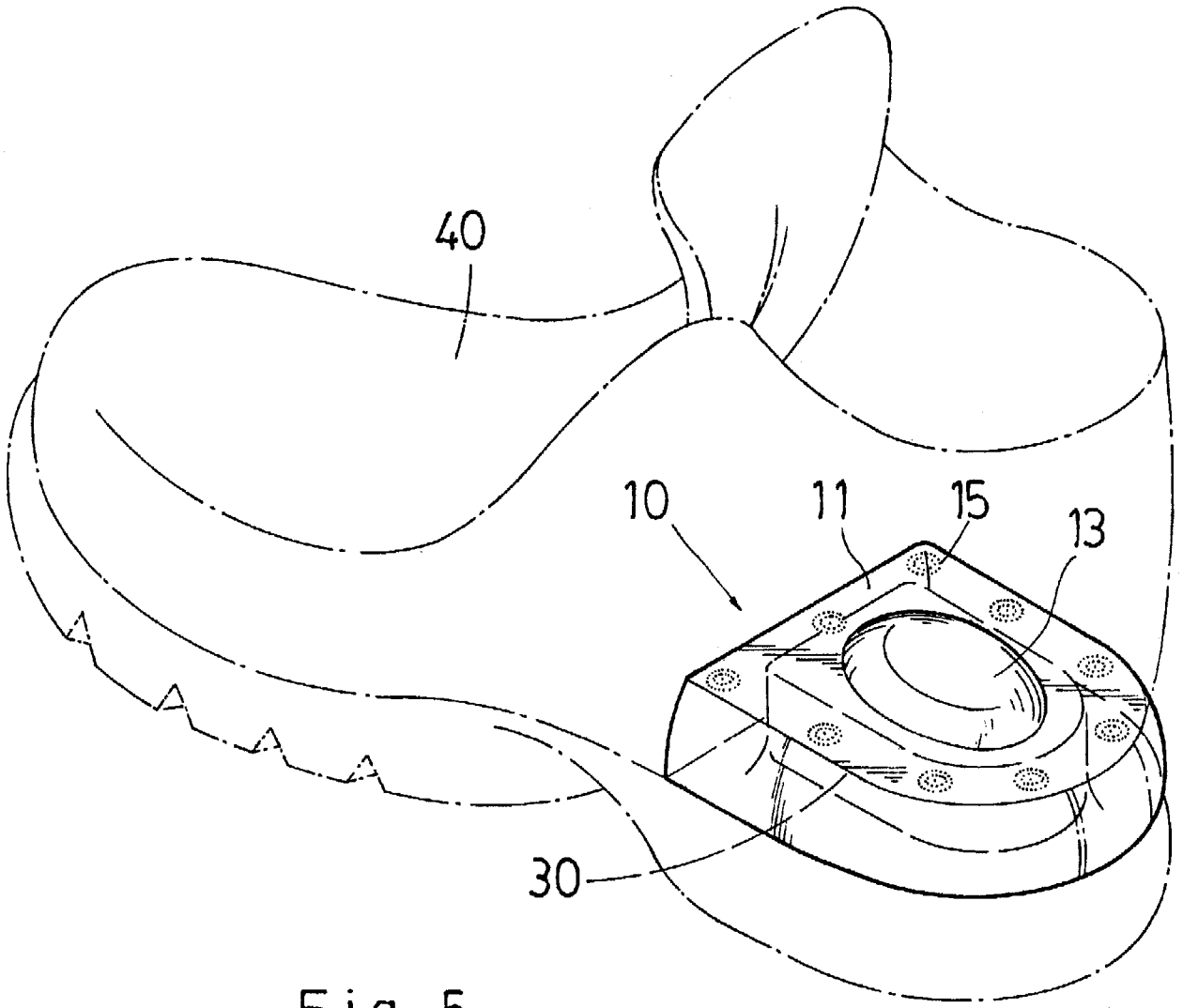
FIG. 5 is an applied view of the present invention, showing the shock absorbing heel block installed in a sports shoe.

FIG. 5 shows the shock absorbing heel block 10 installed in a sports shoe 40. The periphery of the shock absorbing heel block 10 is exposed to the outside. Because the heel block shell 11 is transparent, the inside of the shock absorbing heel block 10 can be seen from the outside. The arrangement of the shock absorbing heel block 10 causes a sense of beauty to the shoe.

Figure 6:
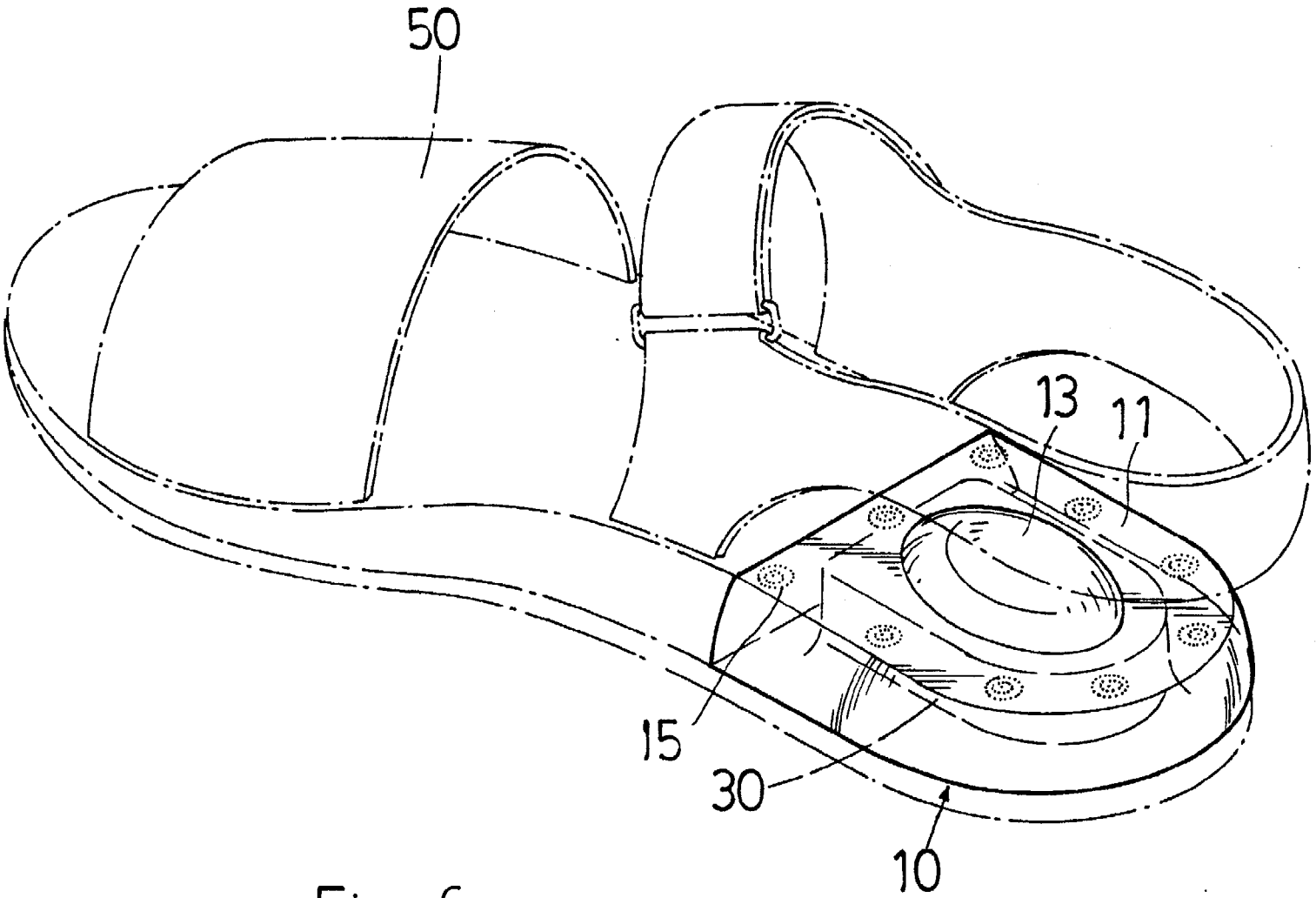
FIG. 6 is another applied view of the present invention, showing the shock absorbing heel block installed in a sandal.

FIG. 6 shows the shock absorbing heel block 10 installed in a sandal 50. The thickness of the shock absorbing heel block 10 is determined subject to the combined thickness of the midsole and insole of the sandal 50. After installation, the shock absorbing heel block 10 form a part of the sandal 50.

What I claim is:

1. A shock absorbing heel block comprising:

a heel block shell adhered to an outsole and arranged in flush with an insole on said outsole, said heel block shell comprising a bottom open chamber, a hollow top wall having a convex upper layer curved outwards and a concave bottom layer curved inwards, said convex upper layer and said concave bottom layer defining an air chamber filled with air; and a piece of elastomeric material fit into the bottom open chamber inside said heel block shell, said piece of elastomeric material having a bottom side adhered to said outsole, and an oval recess at a top side thereof which receives the concave bottom layer of the top wall of said heel block shell.

* * * * *